United States Patent [19]

Bruhm

[11] Patent Number: 4,473,979

[45] Date of Patent: Oct. 2, 1984

[54] FROST BARRIER FOR SKYLIGHTS

[76] Inventor: Ronald R. Bruhm, 37 Hulmar Dr., Downsview, Ontario, Canada

[21] Appl. No.: 280,100

[22] Filed: Jul. 2, 1981

Related U.S. Application Data

[63] Continuation of Ser. No. 104,123, Dec. 17, 1979, abandoned.

[30] Foreign Application Priority Data

May 18, 1976 [CA] Canada ..... 252811

[51] Int. Cl.[3] ..... E04B 7/18

[52] U.S. Cl. ..... 52/200; 52/58

[58] Field of Search ..... 52/200, 60, 58, 97; 285/42

[56] References Cited

U.S. PATENT DOCUMENTS

| | | | |
|---|---|---|---|
| 2,610,593 | 9/1952 | Wasserman | 52/200 |
| 2,676,553 | 4/1954 | Orth | 52/60 |
| 3,359,692 | 12/1967 | Dzwonkas | 52/60 |
| 3,969,858 | 7/1976 | Naidus | 52/200 X |
| 3,979,860 | 9/1976 | Roth et al. | 52/60 X |
| 4,193,237 | 3/1980 | Jankowski | 52/200 |
| 4,223,493 | 9/1980 | Moench et al. | 52/200 |

FOREIGN PATENT DOCUMENTS

| | | | |
|---|---|---|---|
| 2393126 | 2/1979 | France | 52/200 |

*Primary Examiner*—Carl D. Friedman

*Attorney, Agent, or Firm*—Larson and Taylor

[57] ABSTRACT

A skylight having a dome and adapted for setting on a curb or suitable bracket means upstanding from the well in a roof structure to be lighted is made from a self supporting channel shaped frame having an inner leg attachable to the curb and an outer leg attachable to a flashing which is fixed to the roof. The dome sets down upon a pair of flanges integrally formed with the channel and upstanding from its upper surface to create an enclosed dead air space between it and the flange of the dome. The dome is held down upon the channel by the clamping action of a retainer frame which is fixed to the outer leg of the channel.

6 Claims, 2 Drawing Figures

FROST BARRIER FOR SKYLIGHTS

This is a continuation of application Ser. No. 104,123 filed Dec. 17, 1979, abandoned.

FIELD OF THE INVENTION

The present invention relates to a self-flashing skylight and more particularly to a means of constructing a skylight and ventilator using plastic materials to provide frost barriers therein.

PROVISIONS OF THE PRIOR ART

It is common in the installation of skylights hatches or ventilators to use metal to be flashed under the roofing. Metal being a conductor of heat or cold forms a frost build-up on the inside of the building, resulting in a loss of heat and frost cordensing to water on the inside. Semi vinyl or plastic frost barriers are ineffective because in order for the frames to be one piece and leak proof, they must be installed on the innermost portion which still does not give a clear thermal break from the outside. Metal also corodes and requires maintenance.

Known skylights include a metal frame which has lips to trap condensation and drain it to the roof. Since metal has a high rate of heat transmission there will be a good deal of condensation at the frame flange where it holds the dome of the skylight. The unwanted moisture will run into the interior of the skylight damaging the wood of the roof.

OBJECTS OF THE INVENTION

It is the principal object of the invention to provide a frost-free frame for a skylight.

It is a further object of the invention to provide an easily installed and self-flashing frame for a skylight dome.

SUMMARY OF THE INVENTION

I have found that these disadvantages may be overcome by the use of a plastic frame and flashing combination which derive their support from the structure by the addition of a mounting curb of wood or metal for support. The plastic is designed to conform and completely cover the mounting curb as well as flashing under the roofing. This unit being one piece is a better seal, easier to install. It is a complete frost barrier and corrosive and maintenance free and requires no strong metal parts as it derives its strength from the structure itself or building.

DRAWINGS

In the drawings which illustrate the embodiments of the invention.

THE PREFERRED EMBODIMENT OF THE INVENTION

Figure 1:
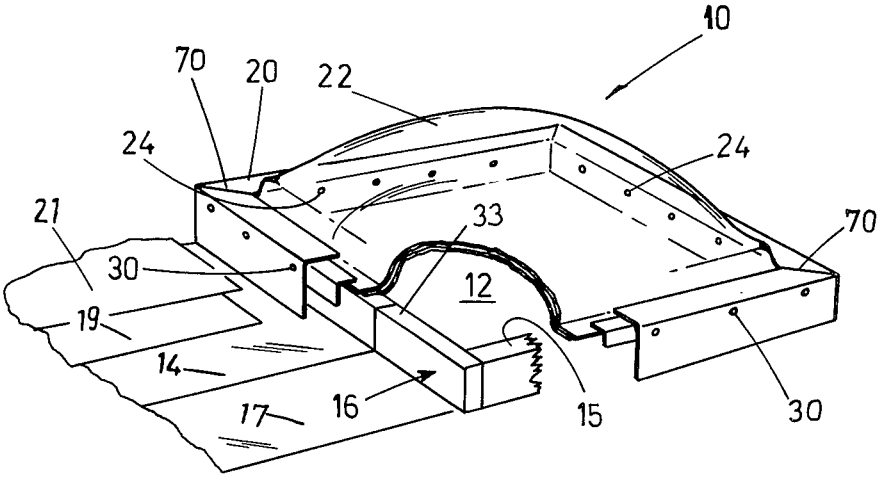
FIG. 1, is a complete installation of typical skylight application for the frame and flashing.

The drawings show the invention of a frame assembly herein designated numeral 10 as a completed skylight installation.

12 is the well opening and 16 is the mounting curb fixed to the wood of the roof of a building. The frame assembly 10 rests on the curbs 16 and comprises a vinyl frost-free barrier member 25 combined with an acrylic dome 22 retained on the frame 25 by retaining frame 20.

Figure 2:
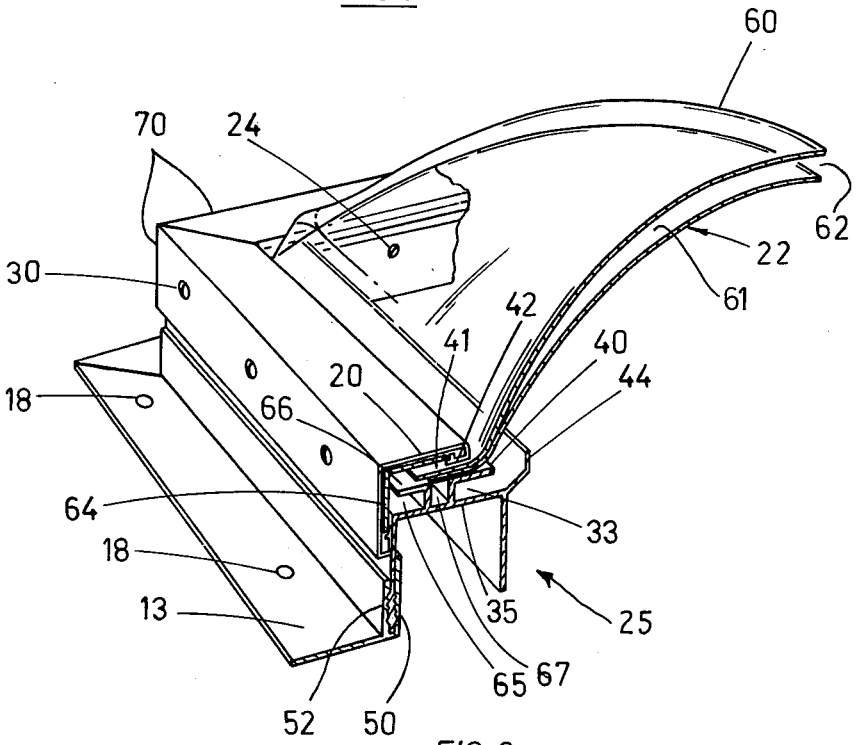
FIG. 2, is a cross section of the same frame.

A self-flashing leg 13 holds the frame 20 and frame 25 secure to the roof. Screw means 30 assists the retention of the components together to form the assembly 10 as shown in FIG. 2. Screw means 24 fixes the frame 25 to curb 16. The frame 25 is also sealed to the curb by suitable mastic material at 35 to provide a complete seal therewith. The frost-free barrier between the dome 22 and frame 25 is created by the upward lip flange 40 overlapping dome flange 41, held together by lip 42 of retainer 20. Moisture drain means 33 is formed by the flanged portion of the outer frame 25.

Roofing cement is applied over the roofing felt along the top of the curb 16 at point 15 where the felt has been carried thereby giving a moisture shield well above the roof surface. The flashing leg 13 is held to the roof by nail means and a feltstrip applied over the flashing. Tar and gravel or shingles are then applied in the usual manner to complete the seal of the flashing.

The component parts of the assembly 25 and 20 with the flanges thereon are made of extrusions of vinyl plastic as is the flashing thereby making a very low heat conductive unit which with the interlocking of their parts becomes a frost and moisture barrier.

The spaces shown between the curb and the frame and the other spaces shown can be dead air for insulation or can be filled with insulation.

FIG. 2 shows the shape of the one-piece channel section frame member 25 in cross-section, with one leg 50 of the channel 25 being held secure in a slot 52 in the upturned end of flashing 13. The attachment of the flashing 13 to the channel 25 has been found to be sufficient to hold the skylight to the roof deck when the flashing 13 has been securely held to the roof as by nails. The curb 16 could be a mere bracket member or continuous as shown for holding the inner leg by screw 24 for additional security. The curb could be wood or other non-conductive, insulating material and the space between the inner and outer legs of the channel-shaped frame 25 will become dead air space for insulation when the inner leg is secured to a curb or other means fixed as 16 is shown to be.

In the embodiment depicted herein the dome 22 of the skylight is shown made in two parts 60,61, with a dead air space 62 therebetween. It is understood that a single formed piece of acrylic material can be used with this invention to provide good results but the use of the pair of mating but separated domes provides the ultimate in frost protection.

To satisfy the strength or fire resistant requirements of the building codes of certain municipal governments, a metal flange 64 can be interfitted between the retainer 20 and the channel 25. To prevent frost transfer by the metal flange a barrier 65 is formed by the flange 66.

An inner heat transfer barrier 67 is created by the enclosure made by the seating of the dome sections 60,61, onto flanges 66,40 which become dead air spaces within the assembled unit.

The retainer frame 20 is made into a one piece unit for ease of handling and effectiveness of its function as a retainer, by having its four sides secured and mitred together at edges 70, prior to the assembly of the retainer 20 over the channel 25.

MODE OF OPERATION

To install the skylight of the present invention in the roof of a structure a curb 16 or like bracket means is first built to upstand and surround a well 12 formed in a roof of the structure to be lighted. The channel 25 formed and mitred into a rectangular or square shape is then fitted over the curb means. The channel 25 is fastened to the curb 16 and the leg or flange flashing 13 of the channel 25 is fastened to the roof. The dome 22 is set down over the top of the channel 25 to cover the gap 67 by resting on both flanges 66,40. The dome 22 is not held to the channel 25 by screws or such like fastening devices thereby insuring that no damage can be caused to the dome material during fitting and also preventing the transfer of frost through such devices. The retainer box frame 20 is then set onto the top of the setting dome flanges and is fixed in place by screw means 30 on its outer side being fastened to the outer leg of the channel 25. The dome is thereby clamped to the channel 25 without the use of frost transferring means being employed at the critical places where heat loss could occur.

What I claim is:

1. A frost-free skylight for installation over a rectangular well in a roof deck comprising:

an upstanding curb attached to the roof deck around the well;

a self-supporting rigid channel-shaped vinyl plastic lower frame made from u-shaped channel sections, each said channel section having a top flange, a downwardly extending outer leg and a downwardly extending inner leg, said channel sections being mated and mitred to form a substantially rectangular frame which receives said curb between said inner leg and said outer leg, said inner legs of said channel sections being fixedly attached to said curb;

a vinyl plastic self-flashing frame formed in substantially rectangular shape and having outwardly extending legs and upstanding legs, said upstanding legs having a downwardly extending slot in which said outer legs of respective ones of said channel sections of said lower frame are force fit to attach said self-flashing frame to said lower frame;

securing means for securing said outwardly extending legs of said self-flashing frame to the roof deck;

a rectangular dome having peripheral flanges;

spacing means for spacing said dome above said channel sections to provide a dead-air frost barrier therebetween including a pair of upstanding flanges attached to said top flanges of each of said channel sections and an upper flange means attached to said pair of upstanding flanges for supporting said peripheral flanges of said dome above said top flanges of said channel sections, said upper flange means being substantially parallel with said top flange of said channel sections; and a clamping frame of substantially rectangular shape which overlays said peripheral flange of said dome and a portion of said outer leg of said lower frame to create a dead-air frost barrier between said clamping frame and said top flange of said channel sections of said lower frame and which is fixedly attached to said outer leg of said lower frame to hold said dome in place.

2. A skylight as claimed in claim 1 wherein said top flanges of said channel sections, said pair of upstanding flanges and said upper flange means are integrally formed.

3. A skylight as claimed in claim 2 wherein said clamping frame includes two integrally formed elongate plates at right angles to each other.

4. A skylight as claimed in claim 1 further including insulation means located between said channel sections and said curb.

5. A skylight as claimed in claims 2 or 4 wherein said dead-air frost barriers are filled with a suitable insulation material.

6. A skylight as claimed in claim 1 further including a plastic sealant material for sealing said self-flashing frame to said channel sections and the roof deck and for sealing said top flanges of said channel sections to said curb.

* * * * *